United States Patent [19]

Aker

[11] 4,423,696

[45] Jan. 3, 1984

[54] IMPROVED BOAT THRUSTER SYSTEM INCLUDING SWIRL REDUCING VANES

[76] Inventor: Charles M. Aker, 2006 Barranca, Newport Beach, Calif. 92660

[21] Appl. No.: 256,528

[22] Filed: Apr. 22, 1981

[51] Int. Cl.[3] ..... B63H 25/46

[52] U.S. Cl. ..... 114/148; 114/151; 440/40; 440/47

[58] Field of Search ..... 114/151, 166, 147, 148; 440/47, 40; 60/221, 222

[56] References Cited

U.S. PATENT DOCUMENTS

| | | | |
|---|---|---|---|
| 943,604 | 12/1909 | D'Equevilley-Montjustin | 114/151 |
| 2,139,594 | 12/1938 | Kort | 114/166 |
| 4,214,544 | 7/1980 | Dashew et al. | 114/151 |

FOREIGN PATENT DOCUMENTS

| | | | |
|---|---|---|---|
| 822948 | 9/1969 | Canada | 114/151 |
| 636825 | 3/1962 | Italy | 114/151 |

*Primary Examiner*—Sherman D. Basinger

*Attorney, Agent, or Firm*—Freilich, Hornbaker, Wasserman, Rosen & Fernandez

[57] ABSTRACT

An improved boat thruster system including a pump for drawing water through an inlet in the boat hull and for discharging water through outlets on both sides of the hull. The improved system includes a plurality of substantially planar vanes mounted in the water flow path proximate to said outlets. The vanes function to reduce swirl angle components in the water flow and thus increase thrust efficiency and to prevent the ingestion of water borne debris into the outlets.

7 Claims, 4 Drawing Figures

IMPROVED BOAT THRUSTER SYSTEM INCLUDING SWIRL REDUCING VANES

FIELD OF THE INVENTION

This invention relates to improvements in boat thruster systems.

BACKGROUND OF THE INVENTION

A variety of boat thruster systems have been proposed for maneuvering and/or propelling a boat by means of pump, pipe and valve arrangements which take water in from the sea and discharge the water through outlets located in the boat hull so as to achieve the desired propulsive or turning effect. Such systems, as described for example, in U.S. Pat. Nos. 4,056,073, and 4,214,544 typically employ pipes of various cross sections which curve or join other pipes or nozzles to form the water transport path. Energy losses frequently occur in the transport path which are attributable to turbulence and, in particular, to a rotational or swirl component within the water flowing through the system.

Another problem occasionally experienced in the use of boat thruster systems is caused by debris such as logs being ingested into the inlet or outlet openings of the thruster system. Prior art devices have employed screens or the like to prevent such ingestion. However, the surface of such screens presents an impediment to the flow of water thus producing an energy loss in addition to the energy losses caused by turbulence and swirl thereby further reducing the useful energy of the water stream for propelling or maneuvering the boat.

SUMMARY OF THE INVENTION

In accordance with the present invention, an improved boat thruster system is provided including means for reducing the turbulence and swirl in the water flow being discharged to the sea as well as for preventing the ingestion of water borne debris.

In the preferred embodiment, vanes are mounted within the water flow path upstream from the outlets to decrease swirl and/or turbulence and thus increase thrust efficiency by increasing the resultant velocity of the flow. The vanes are mounted such that the downstream edges of the vanes form a cruciform proximate to the outlets to block the ingestion of water borne debris.

DESCRIPTION OF THE PREFERRED EMBODIMENT

Figure 1:
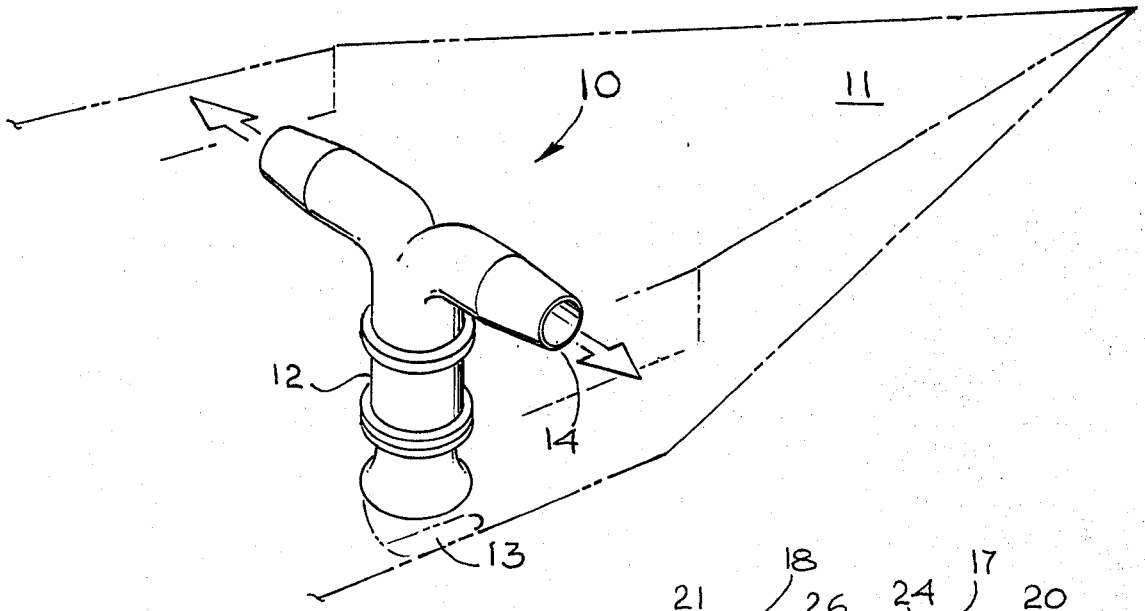
Fig. 1 PRIOR ART
FIG. 1 is a perspective view of a basic prior art boat thruster system.

FIG. 1 illustrates a typical boat thruster system 10 which is mounted in the hull of a boat 11 to facilitate maneuvering of the boat. The system includes a pump 12 which operates to draw water from the sea through inlet 13 and to discharge the water to the sea selectively through starboard and/or port outlets 14, 15 located in the hull proximate to the bow.

Figure 2:
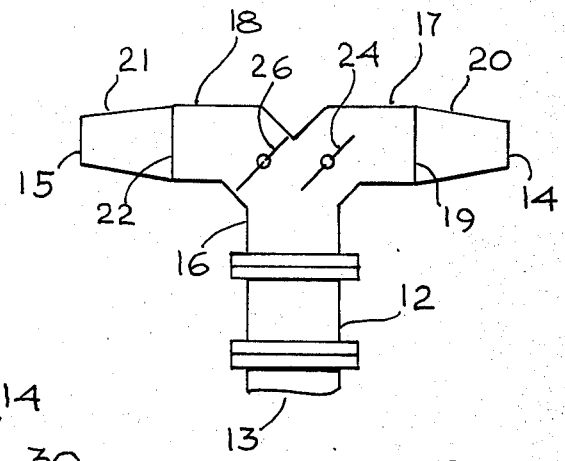
Fig. 2 PRIOR ART
FIG. 2, which essentially corresponds to FIG. 11 of U.S. Pat. No. 4,214,544, schematically depicts a boat thruster system in which the present invention can be advantageously employed.

FIG. 2 which corresponds to FIG. 11 of U.S. Pat. No. 4,214,544 schematically illustrates the boat thruster system of FIG. 1. A first pipe section 16 supplies water from pump 12 to second and third pipe sections 17, 18 respectively terminating at 19,22 in nozzle sections 20, 21. Pipe sections 17, 18 include valve elements 24, 26 for respectively controlling the flow of water from the inlet 13 to outlets 14, 15.

In the use of a thruster system as depicted in FIGS. 1 and 2, the pump 12 is selectively controlled (by means not shown) to draw water from the sea through inlet 13. The valve elements 24, 26 are also selectively controlled (also by means not shown) to direct the water flow from the pump 12 to starboard outlet 14 and/or port outlet 15. Water discharge from starboard outlet 14 tends to pivot the bow toward port. Water discharge from port outlet 15 tends to pivot the bow toward starboard. Although the outlets 14, 15 are illustrated proximate to the bow of boat 11, additional or alternative outlets may also be located proximate to the boat stern.

The aforecited patents described and illustrate various structural configurations and details which are not particularly relevant to the present invention. For present purposes, it will suffice to appreciate the swirl components are typically introduced into the water flow, between pipe section 16 and outlets 14, 15 attributable to various factors including the substantially 90 degree path turn, the presence of the valve mechanism, the rotary motion induced by the impeller blades, etc. The present invention is directed to the incorporation of vanes in the flow path between valve elements 24, 26 and outlets 14, 15 to reduce such swirl components, thereby transforming the wasted energy in the swirl mode to useful energy in the flowing water mass to enhance smooth discharge from the outlets 14, 15 and thus improve thrust efficiency.

Figure 3:
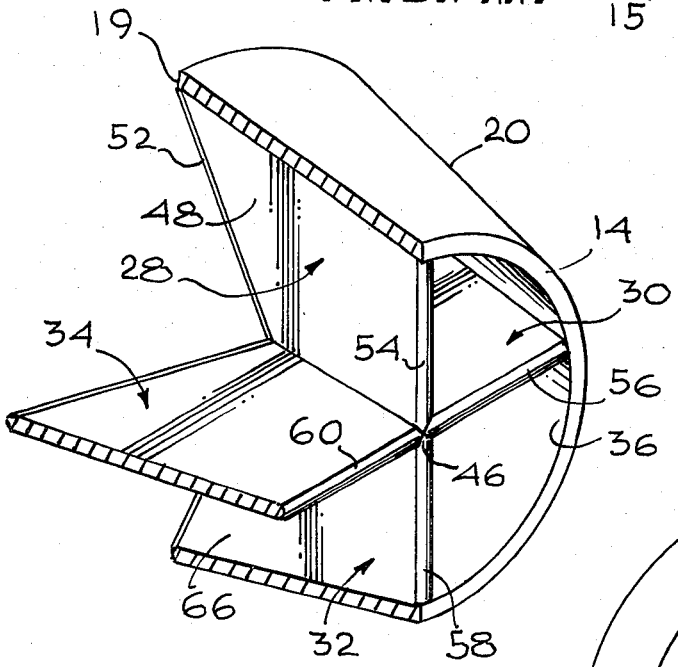
FIG. 3 is a perspective view, partially broken away, illustrating a preferred embodiment of the present invention.

Attention is now directed to FIG. 3 which depicts a preferred configuration in accordance with the invention comprised of multiple planar vanes 28, 30, 32 and 34 mounted within the nozzle 20 just upstream from starboard outlet 14. An identical configuration of vanes is mounted in nozzle 21 just upstream from port outlet 15 and, thus, the following description should be understood as applying to either of the nozzles 20 or 21. Moreover, although the particular embodiment illustrated shows the vanes mounted within the nozzles, it should be understood that the vanes can be advantageously located anywhere in the flow paths upstream from the outlets 14, 15.

Figure 4:
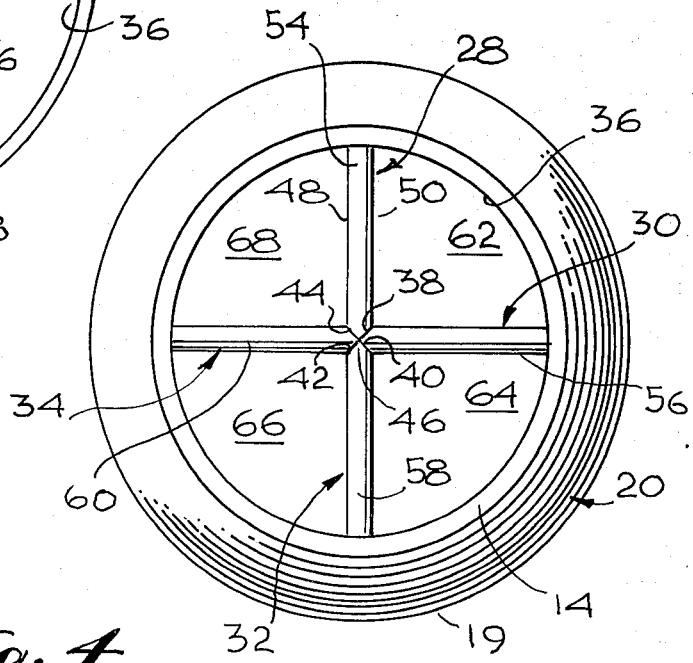
FIG. 4 is an end view of the nozzle of FIG. 3.

As depicted in FIGS. 3 and 4, vanes 28, 30, 32 and 34 are radially and symmetrically connected to the inner surface 36 of nozzle 20. The inner edges 38, 40, 42 and 44 of the respective vanes project into the flow passage defined by inner surface 36 and interconnect along a line 46 substantially coincident with the central axis.

Vane 28 has first and second surfaces 48, 50 which are essentially parallel to the direction of flow through the nozzle. The upstream edge 52 and the downstream edge 54 of vane 28 are preferably streamlined to minimize any turbulence caused by the introduction of vane 28 within the water stream. Such streamlining can be accomplished, for example, by bevelling the edges and then removing any sharp corners. Alternatively, vane 28 could be made sufficiently thin that such bevelling would be unnecessary. The vane 28 serves to minimize swirling and other turbulence within the water stream, thereby tending to increase the velocity of the stream. This reduction in swirl and turbulence within the stream increases the available energy of the stream for maneuvering the boat.

The upstream edge 52 of vane 28 is angled such that the distance from upstream edge 52 to downstream edge 54 is greater at the outer boundary of the flow path, defined by the inner surface 36 of nozzle 20, than at the center of the flow path. Such design insures adequate strength for the vane structure while producing minimum drag for the higher velocity flow components located in the center of the flow path.

Another function of the vanes 28, 30, 32 and 34 is to prevent the ingestion of logs or similar water borne debris into outlet 14 of nozzle 20.

Vanes 28, 30, 32 and 34 are installed in nozzle 20 such that the downstream edges 54,56,58, and 60 divide outlet 14 into four pie shaped areas 62,64,66 and 68 as shown in FIG. 4. This substantially reduces the probability of debris being ingested into outlet 14. The vanes are constructed of cast metal or other hard material having sufficient strength to withstand the impact of logs or other water borne debris.

It is not essential that the nozzles 20, 21 define a water flow path of diminishing cross section from the intakes 19, 22 to the outlets 14, 15 thereof. For example, the invention would be useful if employed in a system wherein nozzles 20, 21 were replaced by cylindrical pipe sections defining a water flow passage of constant cross section.

The thruster system 10 may employ optional thrust directors attached to the outlets 14, 15 of nozzles 20, 21. Such a system is fully explained in U.S. Pat. No. 4,214,544 and depicted in FIG. 12 thereof. The use of such an option does not impair the utilization or performance of the present invention.

From the foregoing, it should be apparent that the present invention provides a novel and useful device for increasing the useful energy of the water mass flowing through a boat thruster system while preventing ingestion of foreign matter into the outlets of the system. It is recognized that different embodiments of the invention may now become obvious to those skilled in the art and the claims associated herewith are intended to include all such embodiments.

What is claimed is:

1. In combination with a boat having a hull, a thruster system mounted in said hull including an assembly of fixedly mounted substantially cylindrical pipe sections, said assembly having an inlet opening through said hull proximate to the bottom thereof and first and second outlets opening through opposite sides of said hull, and pump means located proximate to said inlet for drawing water into said inlet and selectively discharging water through said first and/or second outlets, means for enhancing the thrust produced by water discharged from said outlets, said means comprising:

a first plurality of substantially planar vanes fixedly mounted in said pipe assembly proximate to said first outlet, each vane being oriented so as to define a plane extending substantially parallel to the primary flow path defined by the pipe assembly thereat; and a second plurality of substantially planar vanes fixedly mounted in said pipe assembly proximate to said second outlet, each vane being oriented so as to define a plane extending substantially parallel to the primary flow path defined by the pipe assembly thereat.

2. The combination of claim 1 wherein each of said vanes defines an upstream streamlined edge remote from each of said outlets and a downstream streamlined edge proximate thereto.

3. The combination of claim 2 wherein said first plurality of vanes includes vanes extending radially inward and interconnected along a line substantially coincident with the axis of the pipe assembly thereat and said second plurality of vanes includes vanes extending radially inward and interconnected along a line substantially coincident with the axis of the pipe assembly thereat.

4. The combination of claim 3 wherein said upstream edge of each of said vanes is angled such that the distance along said vane from said upstream edge to said downstream edge is greater at the outer boundary of said primary flow path than at the center thereof.

5. The combination of claim 1 wherein said assembly of pipe sections includes first and second nozzles respectively located adjacent said first and second outlets.

6. In combination with a boat having a hull, an improved thruster system mounted in said hull to facilitate the maneuvering of said boat in water, said thruster system including:

a water inlet means opening through said hull proximate to the bottom thereof;

first and second water outlets opening through said hull respectively in the port and starboard sides thereof;

a first pipe means fixedly mounted substantially vertically in said hull for coupling said water inlet means to the first ends of first and second pipe sections, each fixedly mounted substantially horizontally in said hull and each having second ends respectively coupled to said first and second water outlets;

pump means coupled to said first pipe means for drawing water in through said water inlet means and for supplying water to said first ends of said first and/or second pipe sections for discharge through said first and/or second water outlets, each of said pipe sections defining a primary flow path for water passing therethrough; and means for enhancing the thrust produced by water discharged from said first and/or second outlets, said enhancing means including a first plurality of substantially planar vanes fixedly mounted in said first pipe section and a second plurality of substantially planar vanes fixedly mounted in said second pipe section, each of said vanes being oriented so as to define a planar surface extending substantially parallel to the primary flow path defined by the respective pipe section thereat.

7. The combination of claim 6 wherein said first plurality of vanes is comprised of vanes extending radially inwardly from the inner surface of said first pipe section and interconnected along a line substantially coincident with the axis of said pipe section, said vanes having upstream and downstream edges oriented to define a planar surface which is longer proximate to said pipe section inner surface then proximate to said pipe section axis; and wherein said second plurality of vanes is comprised of vanes extending radially inwardly from the inner surface of said second pipe section and interconnected along a line substantially coincident with the axis of said pipe section, said vanes having upstream and downstream edges oriented to define a planar surface which is longer proximate to said pipe section inner surface then proximate to said pipe section axis.

* * * * *